US010745961B2

(12) United States Patent
Geier

(10) Patent No.: US 10,745,961 B2
(45) Date of Patent: Aug. 18, 2020

(54) ARCHITECTURAL TERRACE DOOR

(71) Applicant: Oldcastle BuildingEnvelope, Inc., Plano, TX (US)

(72) Inventor: Jeff Geier, Weston, WI (US)

(73) Assignee: Oldcastle BuildingEnvelope, Inc., Plano, TX (US)

( * ) Notice: Subject to any disclaimer, the term of this patent is extended or adjusted under 35 U.S.C. 154(b) by 72 days.

(21) Appl. No.: 15/807,841

(22) Filed: Nov. 9, 2017

(65) Prior Publication Data

US 2018/0135347 A1 May 17, 2018

Related U.S. Application Data

(60) Provisional application No. 62/421,004, filed on Nov. 11, 2016.

(51) Int. Cl.
*E06B 1/70* (2006.01)
*E06B 7/23* (2006.01)

(52) U.S. Cl.
CPC ..... *E06B 1/70* (2013.01); *E06B 7/2307* (2013.01); *E06B 7/2316* (2013.01); *E06B 2001/707* (2013.01)

(58) Field of Classification Search
CPC ..... E06B 1/70; E06B 7/2307; E06B 7/2316; E06B 2001/707
USPC ..... 49/467, 468, 469, 470
See application file for complete search history.

(56) References Cited

U.S. PATENT DOCUMENTS 1,890,672 A * 12/1932 Coco ..... E06B 1/70 49/467
1,910,260 A * 5/1933 Reher ..... E06B 1/70 49/467
1,945,859 A * 2/1934 Katz ..... E06B 1/70 49/467
2,089,380 A * 8/1937 Kammerer ..... E06B 1/70 49/468
2,181,812 A * 11/1939 Kammerer ..... E06B 1/70 52/181
2,273,877 A * 2/1942 Kammerer ..... E06B 1/70 49/437
2,319,709 A * 5/1943 Spraragen ..... E06B 7/2314 49/493.1
2,568,477 A * 9/1951 Westlund ..... E05C 17/44 292/288
2,592,861 A * 4/1952 Close ..... E06B 7/2316 49/469
2,856,651 A * 10/1958 Hobbs ..... E06B 1/70 49/468
2,949,651 A * 8/1960 Hill ..... E06B 7/2316 49/493.1
3,148,419 A * 9/1964 Straus ..... E06B 7/2316 49/469

(Continued)

FOREIGN PATENT DOCUMENTS

DE 202012001082 U1 * 5/2012 ..... E06B 1/70

*Primary Examiner* — Jerry E Redman
(74) *Attorney, Agent, or Firm* — Winstead PC

(57) ABSTRACT

The threshold system includes a first support member secured to a walking surface, a second support member secured to the walking surface, and a thermal break joining the first support member and the second support member. A first ramp is removably coupled to the first support member. A second ramp is removably coupled to the second support member.

16 Claims, 4 Drawing Sheets

(56) References Cited

U.S. PATENT DOCUMENTS

| | | | | | |
|---|---|---|---|---|---|
| 3,402,512 | A * | 9/1968 | Peterson | E06B 1/70 | 49/468 |
| 5,673,517 | A * | 10/1997 | Stanclift | E06B 1/70 | 49/468 |
| 6,202,565 | B1 * | 3/2001 | Henry | A62C 33/06 | 104/275 |
| 6,289,635 | B1 * | 9/2001 | Procton | E06B 1/70 | 49/467 |
| 8,726,575 | B1 * | 5/2014 | Vulpitta | E06B 7/22 | 49/470 |
| 10,370,891 | B2 * | 8/2019 | Farahmandpour | E06B 1/70 | |
| 2007/0261312 | A1 * | 11/2007 | Kuppler | A62C 3/14 | 49/470 |
| 2013/0199101 | A1 * | 8/2013 | Rager-Frey | E06B 1/70 | 49/469 |
| 2013/0199102 | A1 * | 8/2013 | Rager-Frey | E06B 1/70 | 49/469 |
| 2019/0106929 | A1 * | 4/2019 | Farahmandpour | E06B 1/70 | |

* cited by examiner

ARCHITECTURAL TERRACE DOOR

CROSS-REFERENCE TO RELATED APPLICATIONS

This application claims priority to, and incorporates by reference the entire disclosure of, U.S. Provisional Patent Application No. 62/421,004, filed on Nov. 11, 2016.

TECHNICAL FIELD

The present application relates generally to door assemblies and, more particularly, but not by way of limitation, to door thresholds and sealing members therefor. In one embodiment, the invention further relates to a threshold method and system providing a low vertical profile for installation on a flat walking surface.

BACKGROUND

The use of thresholds in residential and commercial buildings is an integral part of conventional construction. External doors are most effectively mounted in conjunction with a lower plate or threshold member above which the door may be oriented in a closed position. The threshold may serve multiple functions. For example, the threshold reduces a distance between a surface above which the door swings and a bottom of the closed door. The threshold may also function as a barrier to air and moisture infiltration. In some designs, sealing members are incorporated with the door to reduce or substantially eliminate moisture infiltration under the closed door.

In certain applications, a threshold for a doorway may need to meet certain design requirements. For example, the Americans with Disabilities Act ("ADA") sets forth certain requirements for thresholds to minimize an impact a threshold might have on a person having disabilities ability to pass through the doorway. One such requirement is to reduce a height of the threshold relative to a walking surface upon which the threshold is installed. In order to maintain a low height difference between the threshold and the walking surface, prior thresholds have required modification of the walking surface. For example, the walking surface may either be raised to abut edges of the threshold or a portion of the walking surface may be cut out and removed to form a groove or trough for the threshold to sit in. Incorporating a threshold system using either of these ways can lead to problems. For example, it can be difficult to provide a seal to prevent water from accumulating underneath the threshold. Accumulated water can induce other problems like mildew or mold. Furthermore, for some walking surfaces it may not be desirable or permitted to modify the walking surface with cuts and the like. Therefore, a threshold system that complies with requirements of the ADA, is installable with minimal alteration of the walking surface, and provides an accessible seal to prevent water from accumulating underneath the threshold is desirable.

SUMMARY

The present application relates generally to door assemblies and, more particularly, but not by way of limitation, to door thresholds and sealing members therefor. In one aspect, the present disclosure relates to a threshold system. The threshold system includes a first support member secured to a walking surface, a second support member secured to the walking surface, and a thermal break joining the first support member and the second support member. A first ramp is removably coupled to the first support member. A second ramp is removably coupled to the second support member.

In another aspect, the present disclosure relates to a method of constructing a threshold system. The method includes coupling a first support member to a walking surface, sealing the first support member to the walking surface via a first caulk line, coupling a second support member to the walking surface, and sealing the second support member to the walking surface via a second caulk line. The method further includes concealing the first caulk line with a first ramp that is removably coupled to the first support member, concealing the second caulk line with a second ramp that is removably coupled to the second support member, and coupling a first gasket between the first support member and the second support member, the first gasket extending upwardly from the first support member and the second support member.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
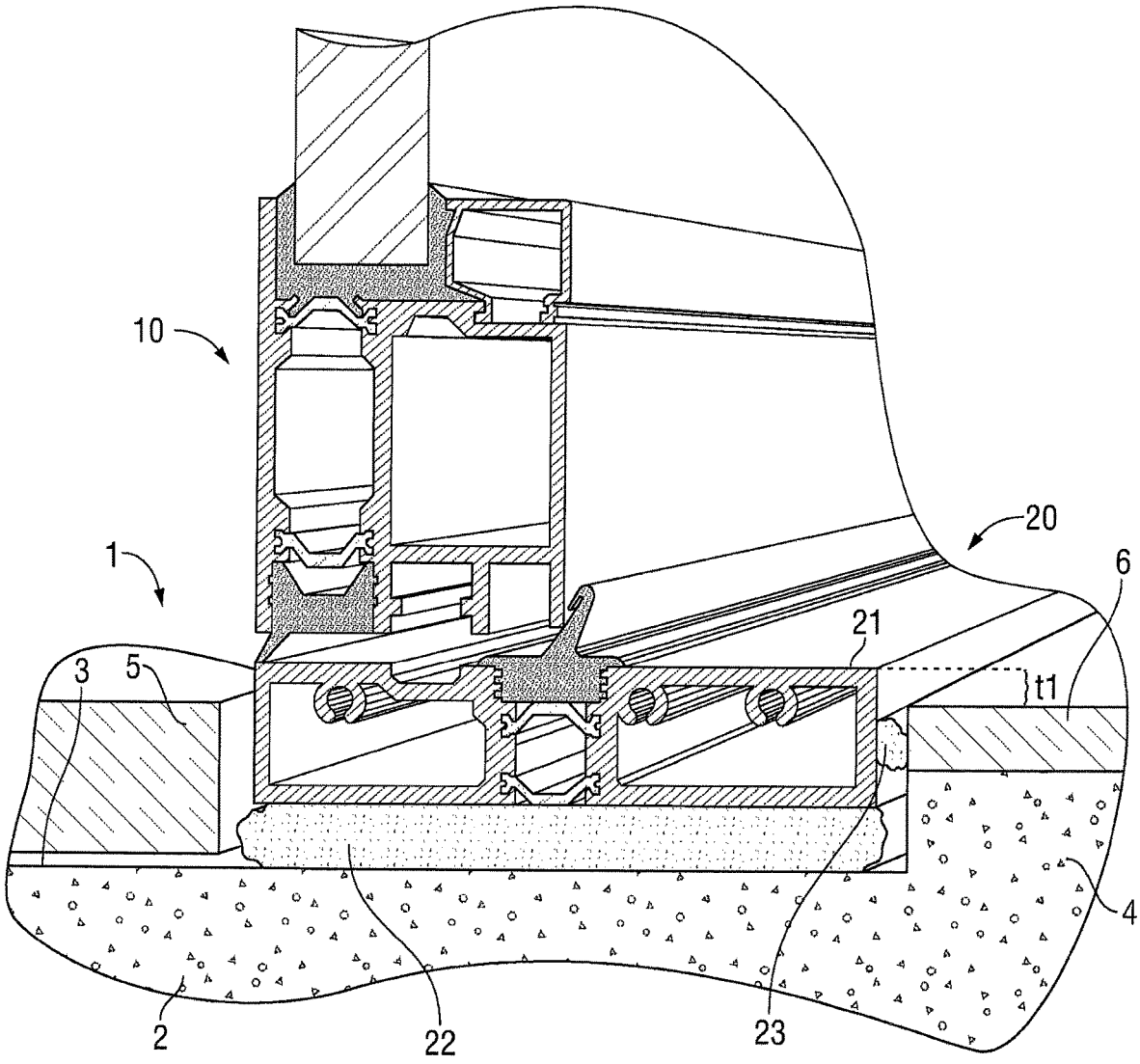
FIG. 1 (Prior Art)
FIG. 1 is a cross-sectional isometric view of a prior art threshold system installed on a walking surface.

FIG. 1 is a cross-sectional isometric view of a prior art threshold system 1 installed on a walking surface 2. The threshold system 1 includes a door assembly 10 and a threshold assembly 20. The door assembly 10 is pivotally connected to a portion of a building at a side edge (not shown) in a conventional manner to allow the door assembly 10 to pivot open. The pivotal engagement may be provided by commercially available hinges, or the like, and is discussed for purposes of illustration only.

As shown in FIG. 1, material from the walking surface 2 has been removed to form a lowered portion 3, the forming of which also created a raised portion 4. The lowered portion 3 has been formed by cutting into a face of the walking surface 2 to accommodate a thickness of the threshold assembly 20. In the embodiment shown in FIG. 1, a block 5 is placed upon the lowered portion 3 and a block 6 is placed upon the raised portion 4 to raise an effective height of the walking surface 2 to a height that is closer to a top surface 21 of the threshold assembly 20. In some embodiments, a groove or trough could be cut into the walking surface 2 to accommodate the threshold assembly 20. In such an embodiment, the blocks 5 and 6 may be unnecessary. While these methods achieve the goal of providing a relatively flat surface, they add complexity to the installation and make it difficult if not impossible to retrofit the threshold assembly 20 into some existing thresholds where modification of an existing walking surface is difficult or not allowed.

As shown in FIG. 1, the threshold assembly 20 sits upon the walking surface 2 so that the top surface 21 of the threshold assembly 20 is roughly on the same level as the raised portion 4 (e.g., a height difference t1 is minimized). The threshold assembly 20 may be secured to the walking surface 2 in a variety of ways, such as, for example, with screws or other fasteners. In order to provide a seal to prevent an inflow of water and air to an area beneath the threshold assembly 20, caulk is typically used. A caulk line 22 is shown between a bottom of the threshold assembly 20 and the walking surface 2 and a caulk line 23 is shown between a right side of the threshold assembly 20 and the walking surface 2. However, it is difficult to ensure that a good seal is in place using this method. For example, the caulk lines 22 and 23 may begin to deteriorate or separate over time. Thus, water and other debris may eventually penetrate the caulk lines 22 and 23 and accumulate under the threshold assembly 20. This is undesirable as it may lead to the formation of mildew and mold.

Figure 2:
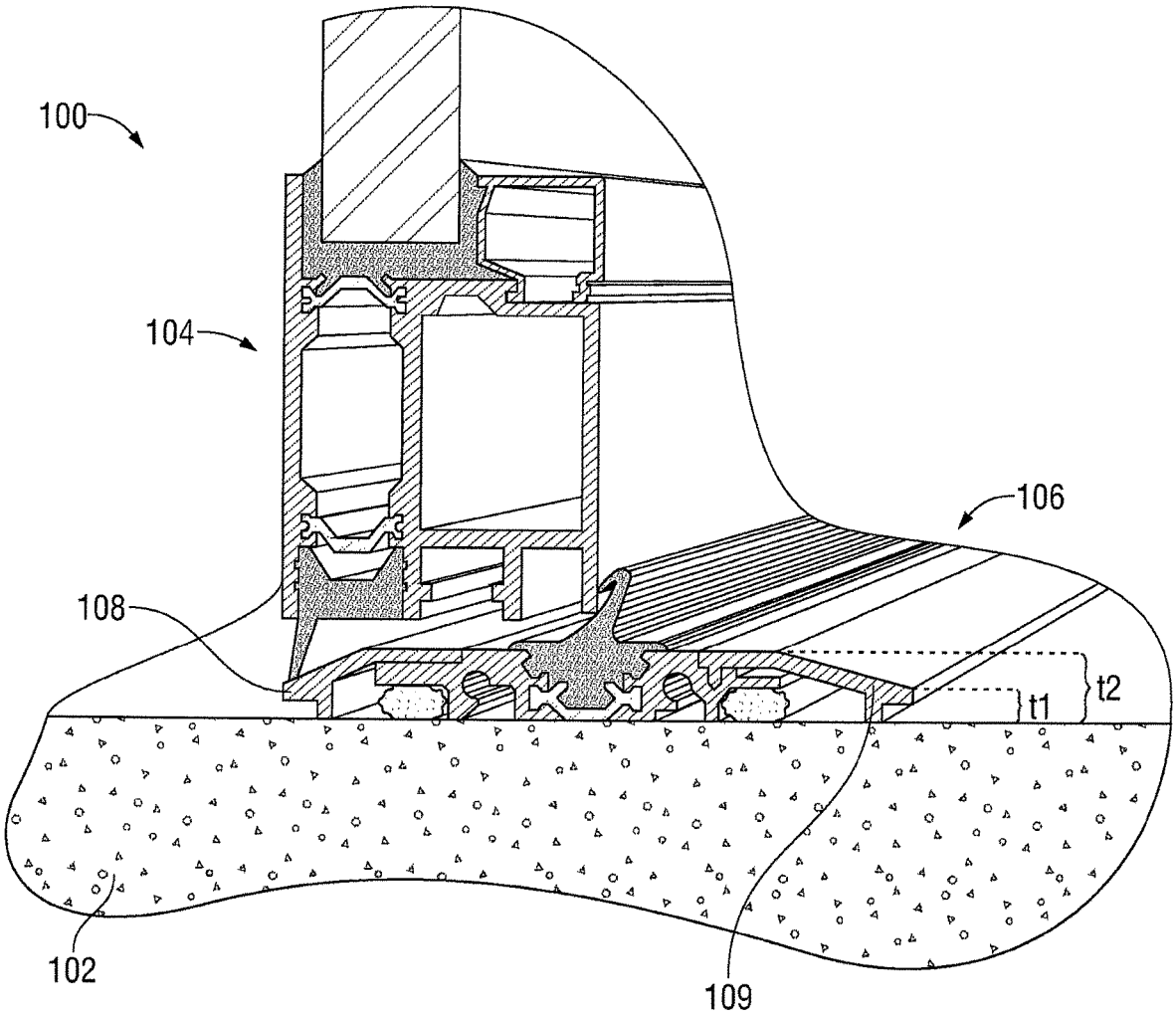
FIG. 2 is a cross-sectional isometric view of a threshold system installed on walking surface according to an exemplary embodiment.

Referring now to FIG. 2, a cross-sectional isometric view of a threshold system 100 installed on walking surface 102 according to an exemplary embodiment is shown. In the embodiment shown in FIG. 2, the threshold system 100 includes a door assembly 104 and a threshold assembly 106. In some embodiments, the door assembly 104 may be similar to the door assembly 10 of FIG. 1. In contrast to the threshold system 1 of FIG. 1, however, the threshold system 100 of FIG. 2 is adapted for use on a flat surface, such as, for example, the walking surface 102—thus cuts into the walking surface 102 are typically not needed. In a typical embodiment, the threshold assembly 106 includes ramps 108 and 109 that reduce an initial profile T1 of the threshold assembly 106 compared to a profile T2, which represents a thickness of a central portion of the threshold assembly 106. The reduced initial profile T1 makes it less likely that someone would trip over the threshold assembly 106 and also makes it easier for a wheelchair user to pass over the threshold assembly 106. Thus, the threshold system 100 may be used in a wide variety of applications and no extensive modification of the walking surface 102 is needed.

Figure 3:
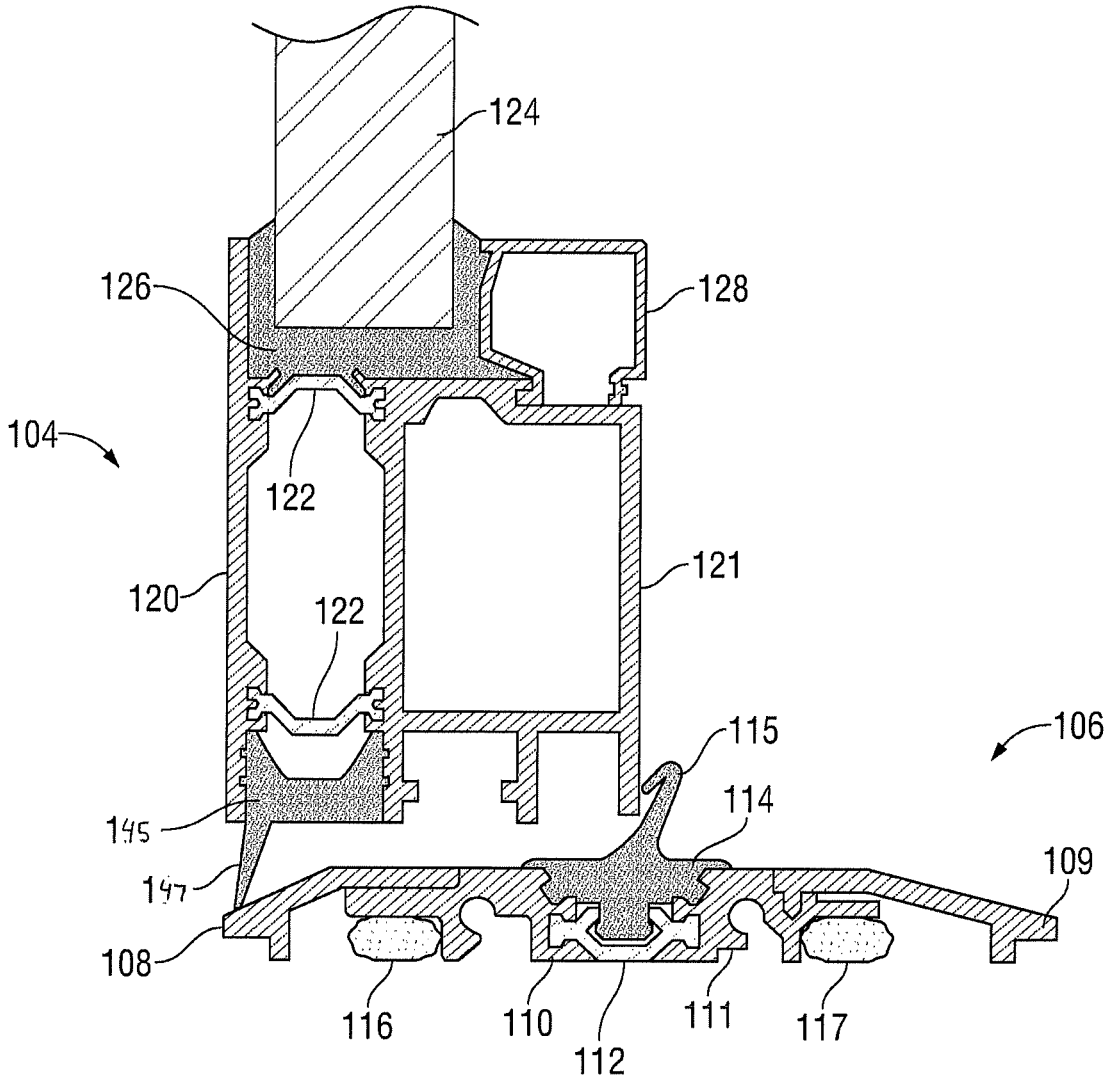
FIG. 3 is a cross-sectional side view of a threshold system according to an exemplary embodiment.

Referring now to FIG. 3, a cross-sectional side view of the threshold system 100 is shown. The door assembly 104 is shown in a closed position in which the door assembly 104 is disposed above the threshold assembly 106. In a typical embodiment, the door assembly 104 comprises a first frame element 120 and a second frame element 121. The first frame element 120 and the second frame element 121 are typically held together by fasteners (e.g., screws) and are typically made of extruded aluminum but may be made from other materials as desired. The first frame element 120 and the second frame element 121 are also joined by thermal breaks 122. Each of the thermal breaks 122 includes flared portions that fit into corresponding grooves formed into the first frame element 120 and the second frame element 121. The thermal breaks 122 are made of insulative materials that help limit heat transfer from one side of the threshold assembly 106 to another side of the threshold assembly 106.

The door assembly 104 includes a panel 124 that may be made from various materials, such as, for example, glass, polymers, wood, metal, and the like. The panel 124 is secured to the frame elements 120 and 121 with a gasket 126 and a locking member 128. The gasket 126 is adapted to cup around an edge of the panel 124 to prevent moisture and air from passing around the edge of the panel 124. In a typical embodiment, the gasket 126 is made of a pliable material such as various rubbers, polymers, and the like. The locking member 128 is adapted to snap into grooves formed in the second frame element 121. When snapped into place, the locking member 128 pinches the gasket 126 against the panel 124 to retain the panel 124 in the door assembly 104.

The door assembly 104 includes a gasket 145 that is secured between the first frame element 120 and the second frame element 121 at a bottom portion of the door assembly 104. The gasket 145 is adapted to provide a seal between the door assembly 104 and the threshold assembly 106 to help prevent air and moisture from passing from one side of the door assembly 104 to another side of the door assembly 104. In a typical embodiment, the gasket 145 is made of a pliable material such as various rubbers, polymers, and the like. The gasket 145 includes a sealing member 147 that extends towards the ramp 108. In a typical embodiment, the sealing member 147 has a length that is sufficient for the sealing member 147 to not only touch the ramp 108, but is long enough that the sealing member 147 presses into the ramp 108 to provide sealing contact with the ramp 108.

In a typical embodiment, the threshold assembly 106 includes a support member 110 and a support member 111 that are joined together via a thermal break 112. The thermal break 112 acts as a thermal barrier to limit a transfer of heat between the support member 110 and the support member 111. A gasket 114 is connected to the support member 110, the support member 111, and the thermal break 112. The gasket 114 provides a seal between the threshold assembly 106 and the door assembly 104 to prohibit moisture and air from passing from one side of the door assembly 104 to the other side of the door assembly 104. The threshold assembly 106 further includes the ramps 108 and 109, which are secured to the support members 110 and 111, respectively. The ramps 108 and 109 reduce an edge profile of the threshold assembly 106 to make a user's passage across the threshold assembly 106 easier.

In a typical embodiment, the support members 110 and 111 are made from extruded aluminum, but other materials may be used as desired. The support members 110 and 111 are structural members that act as anchors for the threshold assembly 106. For example, in a typical embodiment, the support members 110 and 111 are anchored to the walking surface 102 (see FIG. 2) and the remaining components of the threshold assembly 106 are then secured to the support members 110 and 111. In some embodiments, the support members 110 and 111 may be secured to the walking surface 102 with one or more fasteners (e.g., screws, bolts, and the like) or an adhesive. As shown in FIGS. 2 and 3, the support members 110 and 111 may be further secured to the walking surface 102 via caulk applied at caulk lines 116 and 117. In addition to aiding in the securement of the support members 110 and 111 to the walking surface 102, the caulk lines 116 and 117 act as seals to prevent moisture and air passing beneath the threshold assembly 106.

The ramps 108 and 109 are removable from the support members 110 and 111, respectively. The removability of the ramps 108 and 109 makes securing and sealing the support members 110 and 111 to the walking surface 102 simpler. For example, with the ramps 108 and 109 removed, it is easier to inspect the integrity of the seals provided by the caulk lines 116 and 117. In a typical embodiment, the ramps 108 and 109 may be secured to the support members 110 and 111, respectively, with fasteners (e.g., screws, bolts, and the like) or may include one or more interlocking tabs that interact with one or more corresponding grooves formed in the support members 110 and 111.

The gasket 114 attaches to the support member 110, the support member 111, and the thermal break 112 and includes a sealing member 115 that extends upwards towards the door assembly 104. Attachment of the gasket 114 is discussed in more detail below. In a typical embodiment, the sealing member 115 abuts a lower edge of the second frame element 121 to provide a seal that inhibits passage of moisture and air through the threshold system 100. In a typical embodiment, the sealing member 115 is able to lay flat against the support member 111 to facilitate passage of, for example, a wheelchair thereover. The sealing member 115 is resilient such that the sealing member 115 resumes a substantially vertical shape after passage of the wheelchair.

Figure 4:
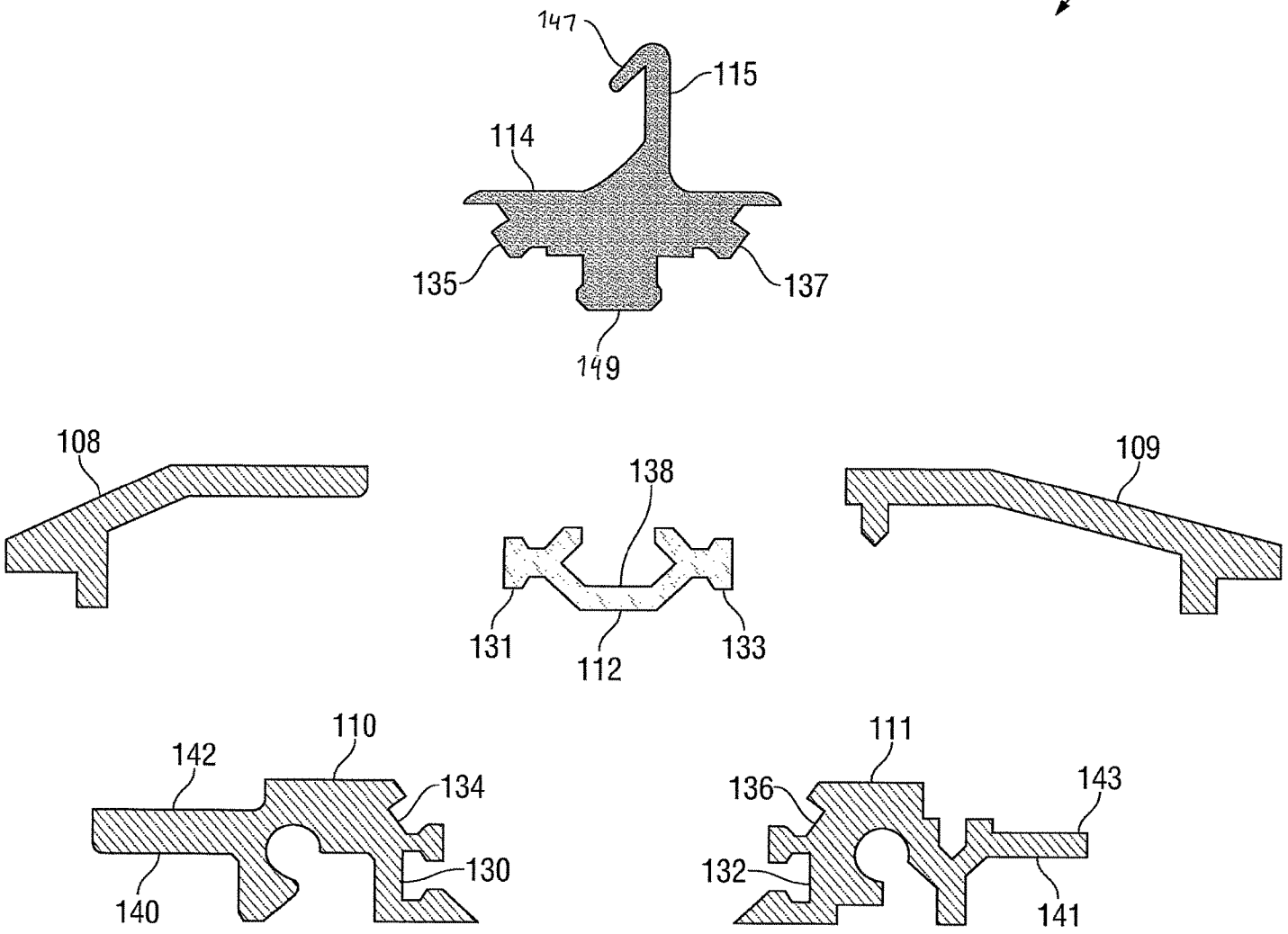
FIG. 4 is an exploded side view of a threshold according to an exemplary embodiment.

Referring now to FIG. 4, an exploded assembly of the threshold assembly 106 is shown. In a typical embodiment, the components of the threshold assembly 106 are adapted to interlock together. For example, the support member 110 includes a channel 130 that is adapted to receive a tongue 131 of the thermal break 112 and the support member 111 includes a channel 132 that is adapted to receive a tongue 133 of the thermal break 112. In a typical embodiment, the support members 110 and 111 may be joined with the thermal break 112 by pressing the tongues 131 and 133 into engagement with the channels 130 and 132. Alternatively, the tongues 131 and 133 may be slid into the channels 130 and 132.

The gasket 114 is adapted to interlock with the support members 110 and 111 and with the thermal break 112. The gasket 114 is made from a material that can bend and flex, such as, for example, rubbers, polymers, and the like. The flexibility of the gasket 114 enables the gasket 114 to provide a good seal with a lower portion of the second frame element 121 and also allows the gasket 114 to bend when a wheel of a wheelchair passes over the gasket 114. In the embodiment shown in FIG. 4, the sealing member 115 includes a finger 139. The finger 139 is adapted to flex so that a tip of the finger 139 folds inward when contacting the second frame element 121.

In a typical embodiment, the gasket 114 includes a tongue 135 that fits into a channel 134 of the support member 110, a tongue 137 that fits into a channel 136 of the support member 111, and a tongue 149 that fits into a channel 138 of the thermal break 112. The gasket 114, similar to the installation of the thermal break 112, may be installed by pressing tongues into corresponding channels or the tongues may be slid into the corresponding channels.

The support member 110 includes a bonding surface 140 and the support member 111 includes a surface 141, each of which provides a bonding area for the caulk lines 116 and 117, respectively. The support member 110 also includes a support surface 142 that supports the ramp 108 and the support member 111 includes a support surface 143 that supports the ramp 109.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A threshold system, comprising:

a first support member secured to a walking surface;

a second support member secured to the walking surface;

a thermal break joining the first support member and the second support member;

a first ramp removably coupled to the first support member;

a second ramp removably coupled to the second support member;

a first flange extending outwardly from the first support member under the first ramp in a spaced parallel relationship to the walking surface; and a second flange extending outwardly from the second support member under the second ramp in a spaced parallel relationship to the walking surface.

2. The threshold system of claim 1, comprising a first gasket disposed between the first support member and the second support member, the first gasket extending upwardly from the first support member and the second support member.

3. The threshold system of claim 1, comprising a first caulk line disposed between the first flange and the walking surface.

4. The threshold system of claim 3, wherein the first ramp conceals the first caulk line.

5. The threshold system of claim 3, wherein selective removal of the first ramp facilitates visual inspection of the first caulk line.

6. The threshold system of claim 3, wherein the first caulk line prevents infiltration of water under the first support member.

7. The threshold system of claim 1, comprising a second caulk line disposed between the second flange and the walking surface.

8. The threshold system of claim 7, wherein the second ramp conceals the second caulk line.

9. The threshold system of claim 7, wherein selective removal of the second ramp facilitates visual inspection of the second caulk line.

10. The threshold system of claim 7, wherein the second caulk line prevents infiltration of water under the second support member.

11. The threshold system of claim 1, wherein the first support member and the second support member are coupled to the walking surface without removal of an upper face of the walking surface.

12. The threshold system of claim 1, comprising a door assembly disposed above at least one of the first support member and the second support member.

13. The threshold system of claim 12, wherein the first gasket seals against the door assembly when the door assembly in in a closed position.

14. The threshold system of claim 12, wherein the door assembly includes a second gasket extending downwardly from the door assembly.

15. The threshold system of claim 14, wherein the second gasket seals against at least one of the first ramp and the first support member when the door assembly is in a closed position.

16. The threshold system of claim 14, wherein the second gasket is elastically deformable and folds downwardly to facilitate passage of objects thereover.

* * * * *